United States Patent [19]

Eadon-Allen

[11] 4,232,485

[45] Nov. 11, 1980

[54] APPARATUS FOR POLISHING CURVED SURFACES

[75] Inventor: Stuart Eadon-Allen, Birmingham, England

[73] Assignee: Dollond & Aitschison (Services) Limited, Birmingham, England

[21] Appl. No.: 933,453

[22] Filed: Aug. 11, 1978

[30] Foreign Application Priority Data

Aug. 13, 1977 [GB] United Kingdom ..... 34083/77

[51] Int. Cl.[3] ..... B24B 13/02

[52] U.S. Cl. ..... 51/55; 51/124L

[58] Field of Search ..... 51/124 L, 33 W, 124 R, 51/234, 115, 55

[56] References Cited

U.S. PATENT DOCUMENTS

| | | | |
|---|---|---|---|
| 2,291,000 | 7/1942 | Simpson | 51/124 L |
| 2,406,789 | 9/1946 | Bardwell et al. | 51/124 L |
| 2,479,204 | 8/1949 | Buchele | 51/124 L |
| 2,633,675 | 4/1953 | Ellis | 51/124 L |
| 2,715,803 | 8/1955 | Bronson | 51/124 L |
| 2,975,565 | 3/1961 | Phillips | 51/124 L |
| 2,977,724 | 4/1961 | Kennedy | 51/124 L |
| 3,093,939 | 6/1963 | Dalton | 51/124 L |
| 3,283,445 | 11/1966 | Lipkins | 51/73 R |

FOREIGN PATENT DOCUMENTS

| | | | |
|---|---|---|---|
| 2721553 | 11/1978 | Fed. Rep. of Germany | 51/124 L |
| 977720 | 4/1951 | France | 51/124L |
| 2332841 | 6/1977 | France | 51/124 L |
| 584919 | 1/1947 | United Kingdom | 51/124 L |
| 317489 | 12/1971 | U.S.S.R. | 51/124 L |

*Primary Examiner*—Harold D. Whitehead
*Assistant Examiner*—K. Bradford Adolphson
*Attorney, Agent, or Firm*—Spencer & Kaye

[57] ABSTRACT

In a machine for smoothing and polishing part-spherical surfaces on lenses, a tool and a lens are supported in contact with each other for rotation about respective axes and one of the tool and lens is driven. One of the tool and the lens is rocked about an axis which is perpendicular to its axis of rotation while the axis of the other of the tool and lens is maintained at a fixed acute angle to the plane in which the rocking occurs.

6 Claims, 1 Drawing Figure

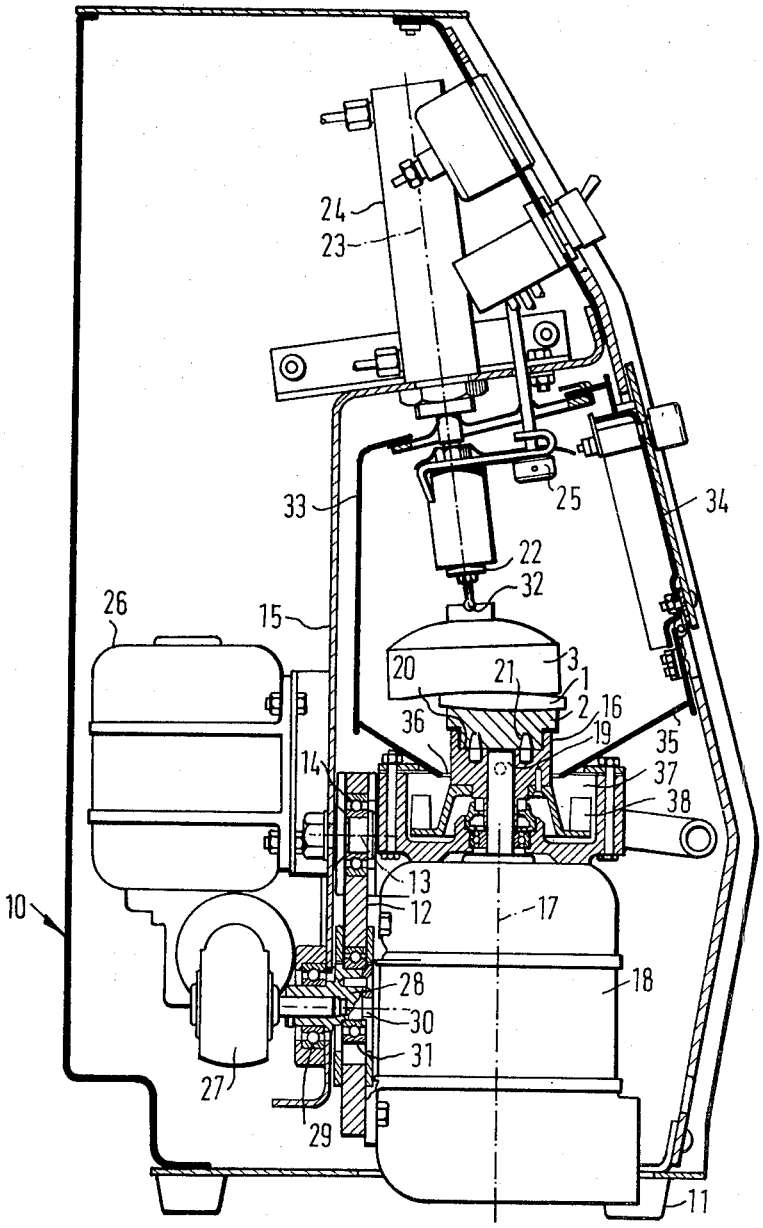
24
23
25
33
34
22
32
26
15
20
21
3
1
2
16
19
36
35
14
37
38
13
12
17
10
18
28
30
31
27
29
11

APPARATUS FOR POLISHING CURVED SURFACES

BACKGROUND TO THE INVENTION

This invention relates to apparatus for smoothing and/or polishing part-spherical surfaces. Such surfaces may be concave or convex. The invention has been developed primary for smoothing and polishing lenses.

Machines which are in use at the present time for smoothing and polishing part-spherical surfaces on lenses each comprise two carriers, one of which is freely rotatable about a first axis and the other of which is rotatable by a motor about a second axis. The lens to be smoothed or polished is mounted on a first of the carriers and the smoothing or polishing tool is mounted on the second of the carriers. The second axis is usually fixed with respect to a base on which the machine stands and the first axis is moved to cause a traversing movement of the tool across the lens and also to maintain proper contact between the working surface of the tool and the surface of the lens which is being smoothed or polished. Traversing of the tool across the lens is necessary to avoid the formation of circular marks on the lens. It is usually desirable to adjust the stroke of the traversing movement when there is a change in the size and/or radius of curvature of the lens surfaces being smoothed or polished. Adjustments of the relative positions of the axes are also necessary so that a considerable proportion of a period which is required to smooth or polish a series of different lenses on a single machine is occupied by adjustment of the machine.

It is necessary for the lens and tool to be urged together resiliently, since some movement of the respective carriers or associated supporting parts towards and away from each other is necessary as the tool traverses across the lens face. Since the lens is not positively held in the machine, there is a possibility of a lens moving completely off the tool during operation. The risk of this occurring increases with increasing speed of operation. For this reason, rotation about the second axis is normally limited to a value in the region of 550 rpm.

SUMMARY OF THE INVENTION

According to the present invention there is provided apparatus for smoothing and/or polishing a part-spherical surface and comprising a first carrier which is rotatable about a first axis, a support which is movable relative to the first axis, a second carrier which is mounted on the support and is rotatable relative to the support about a second axis, the arrangement being such that by moving the support, the second carrier can be moved relative to the first carrier along a curved path which lies in a plane, and the carriers being spaced apart in a direction contained in said plane, the apparatus further comprising biasing means for urging the carriers towards each other and drive means for rotating one of the carriers about its axis and for moving the support.

BRIEF DESCRIPTION OF THE DRAWING

The invention will now be described by way of example with reference to the accompanying drawing which shows a cross section of a machine in accordance with the invention.

DESCRIPTION OF THE PREFERRED EMBODIMENT

The machine comprises a body 10 having feet 11 on which the machine stands. A support 12 of plate-like form is supported within the body 10 for rocking movement about a horizontal axis 13. The support is carried by a bearing 14 secured to an internal wall 15 of the body.

A lower carrier 16 is mounted on the support 12 for rotation relative thereto about an axis 17 which intersects the rocking axis 13 at right angles. Also mounted on the support is a motor 18 for driving the lower carrier, the motor being secured to the support at a position below the carrier 16 and having an upwardly extending output shaft 19, on an upper end portion of which the lower carrier 16 is releasably secured. In an upwardly presented face of the lower carrier there is formed a circular socket 20, from the bottom of which a pair of tapered pins 21 project upwardly. The pins are situated at diametrically opposite positions with respect to the axis 17 and are fixed with respect to the carrier.

An upper carrier 22 is mounted at a position above the carrier 16 for free rotation about an axis 23. The axis 23 is inclined at an acute angle to the axis 17 and diverges upwardly therefrom. The axis 23 may lie in a vertical plane containing the rocking axis 13.

Biasing means is provided for urging the upper carrier 22 resiliently along the axis 23 towards the lower carrier 16. This biasing means comprises a pneumatic piston and cylinder unit 24, the cylinder of which is rigidly mounted on the internal wall 15 of the body with its axis coinciding with the rotary axis 23 of the upper carrier. The piston rod extends downwardly from the cylinder and the upper carrier 22 is mounted on a lower end portion of the piston rod. An adjustable screw stop 25 is provided for limiting downward movement of the upper carrier 22.

A further drive motor 26 is provided for rocking the support 12 and lower carrier 16 about the rocking axis 13. This motor is rigidly mounted on the internal wall 15 of the body and applies rotary drive through a gear box 27 to an eccentric 28 which is mounted in a bearing 29 supported in the wall 15 for rotation about an axis 30 parallel to the rocking axis 13. A portion of the eccentric 28 which is eccentric with respect to the axis 30 co-operates with a circular aperture in the support 12 through a bearing 31. Rotation of the eccentric 28 rocks the support about the axis 13, the limits of the stroke of the support being at positions in which the lower carrier axis 17 is inclined at equal angles to the vertical. Such rocking of the support causes the lower carrier 16 to move relative to the upper carrier 22 along an arcuate path which lies in a vertical plane containing the axis 17.

As shown, for smoothing or polishing a convex part-spherical surface on a lens 1, the lens is mounted on the lower carrier 16. To enable rotary drive to be transmitted to the lens, the lens is adhered in a known manner to a metal pallet 2 having a spigot portion which is complementary to the socket 20, this spigot portion being formed with recesses to receive the drive pins 21. A tool 3 having a complementary concave face is mounted on the upper carrier 22. Since rotary drive is not required to be transmitted from the upper carrier to the tool, and the tool is required to be free to rock in different directions relative to the upper carrier, the upper carrier is provided at its lower end with a part-spherical head 32 which engages in a hemi-spherical recess formed in the tool. The tool is held in contact with the lens under a predetermined pressure which can be controlled by controlling the pressure of air supplied to the piston and cylinder unit 24. Typically, a force of 5 lbs would be applied to the tool.

The motor 18 is energized to rotate the lower carrier 16 and the lens at a speed which is typically in the region of 2,700 rpm. The motor 26 is energised to rock the lens at a relatively low speed to and fro under the tool.

A slurry containing suitable abrasive particles is fed to the interface between the tool and the lens by means of one or more nozzles (not shown). To contain the slurry in the region of the tool and lens, this region is enclosed by a housing 33 having at one side a hinged door 34 through which the lens and tool can be loaded into the machine and removed from the machine. A floor 35 of the housing slopes downwardly towards the lower carrier 16 and between the floor and the lower carrier there is an annular opening 36 through which the slurry can drain into a pump chamber 37. In this chamber, there is an impellor 38 which is secured on the shaft 19 with the lower carrier. The impellor causes the slurry to flow from the chamber 37 to the nozzles from which it is directed to the interface between the tool and the lens.

As can be seen from the drawing, the upper carrier axis 23 diverges upwardly from the lower carrier axis 17 in a rearward direction, that is away from the door 34. The axis 23 intersects the lower carrier 16 at a position to the rear of the axis 17 and therefore intersects the interface between the tool and the lens also at a position to the rear of the axis 17. Movement of the head 32 of the upper carrier is confined to reciprocation along a rectilinear path coinciding with the axis 23.

The centre of curvature of the arcuate path along which the lower carrier 16 and the lens are moved by rocking of the support 12 lies on the rocking axis 13. If the distance from the interface between the lens and the tool to this axis is approximately equal to the radius of curvature of the surface being polished or smoothed, there will be no significiant reciprocation of the upper carrier 12 and tool during operation. Typically, the rocking axis 13 is spaced from the interface between the lens and the tool by a distance of 70 mm. In cases where the radius of curvature of the surface being smoothed or polished differs substantially from this FIGURE, the acceleration of the upper carrier 22 is not so great as to permit the tool to escape from the upper carrier.

It will be noted that no provision is made for adjusting the length of the arcuate path along which the lower carrier 16 is moved during use of the machine. Typically, a point at the centre of the upper side of the lower carrier moves along an arc having a length of 12 mm. The length of such arc is preferably within the range 6 mm to 20 mm. In the particular example shown, this arc lies in a vertical plane. The angle of inclination of the upper carrier axis 22 to this vertical plane is preferably within the range 5°–15° a preferred value being 8°.

In a case where a concave part-spherical surface of a lens is to be smoothed or polished, a tool having a complementary convex surface is mounted on the lower carrier 16 and the lens is mounted by means of a metal pallet on the upper carrier 22. Rotary drive is then transmitted to the tool from the motor 26 and the tool is moved along an arcuate path about the rocking axis 13.

The machine is particularly simple to operate, since no adjustments of the machine are required to be carried out by the operator when smoothing or polishing lenses having differently curved surfaces. The upper carrier 22 is automatically moved by the piston and cylinder unit 24 to accommodate the thickness of the lens. No other changes in the geometry of the machine are necessary. The length of the path along which the lower carrier moves is fixed. The inclination of the axis 22 to the plane in which the lower carrier moves is fixed.

When the driven carrier of the machine illustrated in the accompanying drawing is rotated at a speed in excess of 550 rpm, the risk of a lens moving completely off the tool is less than is the case with the known machine hereinbefore described. This presents the possibility of using a lower pressure between the lens and the tool and/or driving one of the lens and the tool at a higher speed than is usual at the present time. Such higher speed enables a lens surface to be smoothed or polished relatively quickly.

I claim:

1. A combination for polishing curved surfaces comprising a workpiece and a polishing tool having complementary part-spherical surfaces and apparatus for rubbing said surfaces together, wherein the apparatus comprises first carrying means for carrying one of the workpiece and tool for rotation about a first axis, a support which is movable relative to the first axis, second carrying means for carrying the other of the workpiece and tool for rotation about a second axis, the second carrying means being mounted on the support, fluid biasing means for urging the workpiece and the tool into mutual engagement, driving means for rotating one of the workpiece and tool about its axis and for moving the support whereby the workpiece and the tool are rubbed together, and guide means co-operable with the support for guiding the support and second carrying means for movement such that the second axis moves in a plane, the first axis being inclined at an acute angle to said plane.

2. The combination defined in claim 1, wherein the angle of inclination is between 5° and 15°.

3. The combination defined in claim 1, wherein the angle of inclination is about 8°.

4. The combination according to claim 1, wherein the guide means defines a rocking axis about which the support and second carrying means are movable and wherein the angle through which the support is moved about the rocking axis by the driving means is fixed.

5. The combination according to claim 1 further comprising means for guiding one of the workpiece and tool along a rectilinear path towards and away from the other of the workpiece and tool under the action of the biasing means.

6. The combination according to claim 1 wherein the angle of inclination of said first axis to said plane is fixed.

* * * * *